United States Patent [19]

Ivanov et al.

[11] 4,113,499

[45] Sep. 12, 1978

[54] SUSPENSION FOR MAKING MOLDS IN DISPOSABLE PATTERN CASTING

[76] Inventors: Valentin Nikolaevich Ivanov, Proletarsky prospekt, 15, kv. 120; Anna Davydovna Chulkova, Abelmanovskaya ulitsa, 5, kv. 88, both of, Moscow, U.S.S.R.

[21] Appl. No.: 668,185

[22] Filed: Mar. 18, 1976

[51] Int. Cl.[2] ..... B28B 7/34

[52] U.S. Cl. ..... 106/38.35; 106/38.2; 106/38.3; 106/287.16

[58] Field of Search ..... 106/38.3, 38.35, 38.2, 106/38.22, 287 SE; 164/25

[56] References Cited

U.S. PATENT DOCUMENTS

| | | | |
|---|---|---|---|
| 3,428,465 | 2/1969 | McLeod | 106/38.35 |
| 3,432,312 | 3/1969 | Feagin et al. | 106/38.35 |
| 3,725,090 | 4/1973 | Lyass et al. | 106/38.35 |
| 3,870,529 | 3/1975 | Okumoto et al. | 106/38.35 |

*Primary Examiner*—Lorenzo B. Hayes

*Attorney, Agent, or Firm*—Lackenbach, Lilling & Siegel

[57] ABSTRACT

A suspension for making molds, containing a binder which comprises alkyl silicate, water and hydrochloric acid, a refractory filler which has a grain size mainly of not more than 50 mu, and a surfactant featuring a wetting and plasticizing effect. Moreover, the composition of said suspension incorporates a phosphate.

The weight percentage of said components in the suspension is as follows:

alkyl silicate — 2.5 — 9.0
water — 16.5 — 23.0
hydrochloric acid — 0.05 — 0.25
phosphate — 0.2 — 1.0
surfactant — 0.02 — 0.10
refractory filler — the balance.

6 Claims, No Drawings

SUSPENSION FOR MAKING MOLDS IN DISPOSABLE PATTERN CASTING

The present invention relates to foundry practice and more particularly to suspensions for making molds in disposable pattern casting.

The present invention may prove to be most advantageous in the mass or lot production of machine and instrument parts.

Actually foundry molds are made by dipping patterns in a suspension which is followed by powdering them with a refractory and hardening of a produced layer. The number of such layers is three and more, depending on the mass and overall dimensions of an assembly of patterns.

As a rule, the composition of a liquid phase of said suspension includes expensive organo-silicon compounds — alkyl silicates: methyl-, ethyl-, butyl and isopropyl silicates, ethyl silicates being employed preferably.

Further improvement of said suspensions is aimed, firstly, at providing a high bench life, i.e. a capacity to retain stable functional properties over a long period of time, and, secondly, at enhancing the specific strength of the molds obtained by hardening said suspension, which allows diminishing the number of layers building up a mold or producing heavier castings or, finally, assuring a saving in alkyl silicates.

The term "specific strength" is used herein to denote an absolute static bending strength of a mold specimen reduced to 1% of fictitious silica content in alkyl silicates.

Alkyl silicate binder-based suspensions usually contain a considerable quantity of organic solvents. Accordingly, since these solvents are all toxic as well as fire and explosive hazards, it is very important that these dangers be minimized.

High organic solvent content in the suspensions not only adversely affects working conditions and add to fire hazards but adversely affects functional properties of the composition. Thus, the composition of a suspension for making foundry molds (see, e.g., U.S. Pat. No. 3,576,652, Cl.106-38.35) incorporates acetone. However, high acetone volatility leads to an intense increase in suspension viscosity and prevents obtaining an adequate refractory powdering owing to early drying of the suspension layer. Non-uniform powdering layers give rise to cracks in molds.

To overcome said disadvantage use is made of special acetone vaporization depressors or a single inexpensive solvent is replaced by a combination of less volatile organic diluents, thus complicating the production process and necessitating the use of such toxic material as methyl alcohol, benzol, methyl isobutyl ketone and petrol. The introduction of the vaporization depressors, as well as the application of said combination solvents do not obviate the use of a large number of fire- and explosion-hazardous substances.

To provide adequate mold strength in the disposable pattern process use is made of suspensions with a high alkyl silicate content. Thus, known already in the prior-art is a suspension (see, e.g., British Pat. No. 1,287,432, Cl.C1A), comprising a binder of ethyl polysilicate, isopropyl alcohol, water and hydrochloric acid, and a refractory filler, the weight percentage of the components being as follows:

ethyl polysilicate — 19.5 isopropyl alcohol — 11.1
water — 1.65
hydrochloric acid — 0.04
filler — the balance.

Also known is a suspension for making molds in disposable pattern casting (see, e.g., French Pat. No. 2,070,366) whose composition incorporates an ethyl silicate-based binder containing over 25% of fictitious silica, i.e. over 18.5% by weight of ethyl silicate as calculated for the suspension composition.

However, said suspensions are expensive owing to a high ethyl silicate content.

To make a mold less costly and to decrease ethyl silicate requirements use is made of combination binders. Known already in the prior-art is an alkyl silicate binder employed in combination with epoxy resins or benzene polystyrene solutions (see, e.g., U.S. Pat. No. 3,576,652, Cl.106-28.35). Said materials add considerably to gas evolution properties of the mold and, hence, to a probability of blow holes in castings. Moreover, the use of polystyrene and epoxy resins in the disposable pattern process, comprising firing at a temperature of 800°–1000° C., results in atmospheric pollution with carcinogenic products.

Also known are two compositions of suspensions for making foundry molds (see, e.g., British Pat. No. 1,207,101, Cl.B5A). One of said compositions employs an aqueous-alcohol solution of ethyl silicate containing 50% of ethyl silicate, whereas the other one uses aqueous solutions of sodium and potassium silicate as a binder, a feature which naturally reduces the cost of the molds. Said suspensions are applied in layers on a pattern, i.e. a combination coating is obtained. However, this combination may cause mold cracking at high temperatures owing to different thermophysical properties of the layers. It may also deteriorate the accuracy of the castings being produced in said molds due to high plastic deformations of the layers obtained from the suspension using aqueous solutions of sodium and potassium silicates as a binder, at the temperatures required for firing the mold and pouring metal therein.

Attempts at producing less costly suspensions for making moldes in disposable pattern casting, as well as at minimizing fire- and explosion hazards in the suspension- and mold-making process resulted in providing a suspension (see, e.g., Inventor's Certificate of the USSR No. 162638) containing ethyl silicate, water, hydrochloric and sulfuric acids employed as a binder, and a refractory filler, the weight percentage of the components being as follows:

ethyl silicate — 12–15
water — 13.5–16.5
hydrochloric acid — 0.2–0.3
sulfuric acid — 0.15–0.20
pulverized quartz - filler — the balance.

However, the composition of said suspension incorporates large amounts of ethyl silicate and the molds feature low strength. The specific bending strength ranges from 5.9 to 7.3 kgf/cm$^2$.

Also known is another suspension for making molds in disposable pattern casting (see, e.g., Inventor's Certificate of the USSR No. 426743), comprising ethyl silicate, water, hydrochloric and sulfuric acids employed as a binder, a refractory filler and a surfactant that is sparingly adsorbed on the surface of filler grains, the weight percentage of the components being:

ethyl silicate — 5–9
water — 14–18 hydrochloric acid — 0.25–0.35
sulfuric acid — 0.25–0.35
surfactant sparingly adsorbed on filler grain surface — 0.02–0.10
refractory filler — 75–77.

The surfactant sparingly adsorbed on the surface of the filler grains features a wetting and plasticizing power by virtue of which the molds exhibit a higher bending strength of about 40 kgf/cm$^2$, their specific strength being 5.65 kgf/cm$^2$. In terms of its strength characteristics said suspension is superior to those containing water as a diluent, yet it is inferior to traditional compositions, comprising organic solvents. The bench life of said composition is not great; it amounts to about 48 hrs. Said small bench life of the suspension restricts the range of surfactants which may have been employed therein. A number of surfactants in wide use and not costly, such as alkyl sulfates, alkyl-aryl sulfonates, on being introduced into the composition cause rapid coagulation thereof. A limited bench life of the suspension and low strength of the molds produced thereof are associated with a relatively high concentration of strong hydrolysis reaction and alkyl silicate polycondensation catalysts, which are present in the suspension simultaneously - hydrochloric and sulfuric acids. The high rate of said reactions determined by a high content of said acids - catalysts causes suspension aging and the formation of coarse-disperse binding gel with inherent stresses.

The main object of the present invention is the provision of a suspension for making foundry molds which would not contain organic solvents and would retain its functional properties over a long period of time, i.e. would feature a long bench life, assuring better physicomechanical properties of the molds both in a cold and hot state at a lower consumption of ethyl silicate, particularly ensuring a higher specific strength of the molds.

In accordance with the aforementioned and other objects the essence of the present invention consists of a suspension for making molds for disposable pattern casting, containing alkyl silicate, water and hydrochloric acid as a binder, a refractory filler with a particle size mainly not over 50 mu, and a surfactant featuring a wetting and plasticizing effect, according to the invention, comprises phosphates, the weight percentage of the components being as follows:

alkyl silicate — 2.5–9.0
water — 16.5–23.0
hydrochloric acid — 0.05–0.25
phosphate — 0.2–1.0
surfactant featuring wetting and plasticizing effect — 0.02–0.1
refractory filler — the balance.

The hydrochloric acid, phosphate and surfactant contents are given as calculated for an active component.

Alkyl silicates are orthosilicic acid esters. Methyl-, ethyl-, isopropyl- or butyl silicates can be also employed, ethyl silicate with a 28 to 52% fictitious silica content being preferable.

As for the wetting and plasticizing surfactants, use may be made of a wide range of materials: alkyl sulfates, alkyl-aryl sulfonates salts of sulfosuccinic acid esters, salts of condensation products of fatty acid chlorides with methyl taurine (methaupon), oxy-ethylated alkyl phenols and aliphatic series alcohols, glycidol-derivatives of alkyl phenol, and sulfonated oxy-ethylated compounds.

Pulverized materials, such as crystalline and fused quartz, chamotte (refractories which have the general formula $n.Al_2O_3.mSiO_2$), alundum, zirconium silicate, zirconium dioxide can be used as a refractory fine-disperse filler. Fine-disperse refractories are also adaptable with a total up to 2.0% impurity content, including iron entrained while grinding the refractories by using steel or iron grinding means. The above-specified component compositions correspond to a refractory filler having a density of 2.7 g/cm$^3$, e.g., quartz. When using another filler, such as, zirconium dioxide with a 5.73 g/cm$^3$ density, the component ratio must be recalculated accordingly.

It is expedient that the suspension contain such phosphates as: orthophosphoric acid or diphosphates of the following elements - copper, magnesium, calcium, zinc, aluminium, titanium, chromium, manganese, iron, nickel, cobalt, zirconium, barium.

As to other phosphates to be incorporated into the suspension composition, use can be also made of compositions containing two and more diphosphates, e.g., alumochromophosphate (phosphates of aluminum and chromium).

The phosphates can be either prepared separately or introduced into the suspension with materials forming said phosphates, such as, metals, their oxides or hydroxides together with orthophosphoric acid. In this case diphosphates are produced at the same time as the suspension proper is being prepared.

The suspension of the above-specified composition exhibits a 2–3-fold increase in its bench life and a 1.5–2-fold increase in its specific strength, as compared with the similar prior-art compositions without organic solvents. In terms of said parameters it is not also inferior to traditional compositions, comprising organic solvents and in certain functional properties it is even superior: it features a high sedimetrical stability, its density rises slowly (1–2 s per hour with continuous stirring), an ignition temperature in an open container varies from 70° C. to 90° C., the suspension building up uniform layers without inflows.

High functional properties of the proposed suspension are determined by the adopted ratio of its components, as well as by the presence of said phosphates. An extended bench life is provided because the introduction of said compounds imparts buffer properties to the suspension, i.e. its pH changes very little over a long period of time, in spite of a decreased concentration of hydrochloric acid due to its volatility or to acid consumption for reactions with the filler impurities occurring with time.

Improved physicomechanical properties depend on high adhesion of phosphates to filler grains and to reactions between the phosphates and amorphous silica of the ethyl silicate binder, said silica becoming active at the instant it is produced. The reaction products exhibit properties. The introduction of phosphates proper also adds to suspension strength.

The suspension, according to the invention, is prepared by intense stirring of all its constituents at a rate of 1000–3000 rpm which lasts 30–60 min. After that it is applied in layers to patterns, powdered with a refractory with a grain size of at least 100 mu, e.g., quartz sand. A pattern composition is removed from the hardened mold by any known method.

| No. of Ex. | Suspension composition, % by weight: Alkyl silicate (name and concentration) | Water | Hydrochloric acid | Phosphate: Phosphoric acid | Phosphate: Diphosphates | | Suspension and mold properties: Refractory filler the balance | Viscosity(s) 0 hr | Viscosity(s) 48 hrs | Bending strength kgf/cm² 20° | Bending strength kgf/cm² 900° | Specific bending strength (per 1% of fictitious silica) 20° | Specific bending strength (per 1% of fictitious silica) 900° | Notes |
|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 |
| 1. | 9TC-40; 2.0 | 23.5 | 0.125 | 0.75 | — | Methaupon; 0.1 | Pulverized quartz | 44 | 47 | 24.8 | 38.1 | 31.0 | 47.6 | Inadequate strength |
| 2. | 9TC-40; 2.5 | 23.0 | 0.15 | 0.75 | — | " | " | 38 | 43 | 31.5 | 43.9 | 31.5 | 44.0 | |
| 3. | 9TC-52; 2.8 | 22.7 | 0.20 | 0.75 | — | " | " | 40 | 45 | 36.8 | | 19.2 | | |
| 4. | 9TC-40; 4.8 | 20.7 | 0.125 | 0.75 | — | alkyl-aryl sulfonate; 0.08 | " | 40 | 49 | 57.9 | | 30.0 | | Owing to stabilizing effect of phosphates a diversified range of surfactants can be used |
| 5. | " | 20.7 | 0.125 | 0.75 | — | alkyl sulfate; 0.08 | " | 45 | 56 | 54.2 | | 28.3 | | |
| 6. | " | 20.7 | 0.125 | 0.75 | — | Na-salt of sulfosuccinic acid ester; 0.10 | " | 39 | 47 | 52.0 | | 27.0 | | |
| 7. | " | 20.7 | 0.125 | 0.75 | — | Sulfonated oxy-ethylated aliphatic series alcohol; 0.08 | " | 42 | 49 | 57.6 | | 30.0 | | |
| 8. | 9TC-40; 9.0 | 16.5 | 0.25 | 0.75 | — | Methaupon; 0.1 | " | 42 | 58 | 75.4 | 116.6 | 21.0 | 32.3 | In examples No. 11 and No. 12 the denominator (column 11) gives the strength of a mold made from a suspension that has been stored for 48 hrs. |
| 9. | 9TC-40; 9.5 | 16.0 | 0.25 | 0.75 | — | " | " | 48 | 79 | 76.2 | 120.5 | 20.0 | 31.5 | |
| 10. | 9TC-32; 9.0 | 16.5 | 0.20 | 0.75 | — | Oxy-ethylated alkyl phenols; 0.05 | " | 50 | 67 | 60.8 | | 29.4 | | |
| 11. | 9TC-40; 7.5 | 18.0 | 0.25 | 0.20 | — | Methaupon; 0.1 | " | 34 | 42 | 64.4 / 58.7 | 114.8 | 21.5 | 38.3 | |
| 12. | " | 18.0 | 0.25 | 0.10 | — | " | " | 35 | 64 | 62.3 / 41.0 | 97.3 | 20.5 | 32 | The bench life is appreciably lower than in Example 11. |
| 13. | 9TC-40; 6.7 | 18.8 | 0.06 | 1.0 | — | " | " | 40 | 47 | 69.1 | 134 | 25.8 | 50.0 | |
| 14. | " | 18.8 | 0.06 | 1.15 | — | " | " | 37 | 42 | 74.8 | 153 | 27.8 | 57.0 | Reduced gas permeadility and yielding of the mold owing to high phosphate content. |
| 15. | 9TC-40; 4.8 | 20.7 | 0.125 | 0.75 | — | " | alundum | | | 59.3 | 114.3 | 30.8 | 59.5 | |
| 16. | " | 19.2 | 0.125 | 0.75 | — | " | chamotte | | | 51.0 | 108.2 | 26.8 | 56.5 | |
| 17. | 9TC-40; 8.0 | 17.5 | 0.15 | — | magnesium phospate; 0.9 | Alkyl-aryl sulfonate; 0.08 | pulverized quartz | 40 | 49 | 57.6 | 93.6 | 18.0 | 29.3 | |
| 18. | " | 17.5 | 0.15 | — | aluminium phosphate; 0.9 | " | " | 38 | 41 | 60.2 | 114.8 | 18.8 | 35.9 | |
| 19. | " | 17.5 | 0.15 | — | calcium phosphate; 0.8 | " | " | 44 | 58 | 56.1 | 100.8 | 17.5 | 31.5 | |
| 20. | " | 17.5 | 0.15 | — | titanium phosphate; 0.9 | " | " | 37 | 41 | 58.4 | 108.9 | 18.3 | 34.0 | |
| 21. | " | 17.5 | 0.15 | — | chromium phosphate; 0.9 | " | " | 35 | 37 | 61.4 | 103.2 | 19.5 | 32.3 | |
| 22. | " | 17.5 | 0.15 | — | manganese phosphate; 0.9 | " | " | 39 | 42 | 55.4 | 94.4 | 17.4 | 29.5 | |
| 23. | " | 17.5 | 0.15 | — | iron phosphate; 0.6 | " | " | 36 | 41 | 64.8 | 115.8 | 20.3 | 36.0 | |
| 24. | " | 17.5 | 0.15 | — | cobalt phosphate; 0.8 | " | " | 35 | 39 | 50.1 | 97.6 | 15.8 | 30.5 | |
| 25. | " | 17.5 | 0.15 | — | nickel phosphate; 0.9 | " | " | 37 | 41 | 57.2 | 96.0 | 18.0 | 30.0 | |
| 26. | " | 17.5 | 0.15 | — | copper phosphate; 0.9 | " | " | 36 | 42 | 67.2 | 97.6 | 21.0 | 30.5 | |
| 27. | " | 17.5 | 0.15 | — | zinc phosphate; 0.6 | " | " | 41 | 49 | 56.8 | 88.0 | 17.8 | 27.5 | |
| 28. | " | 17.5 | 0.15 | 0–6 | copper oxide; 0.3 | " | " | 40 | 48 | 68.0 | 99.2 | 21.3 | 31.0 | Phosphate is prepared simultaneously with the suspension |

EXAMPLE 14.9 l of water, 355 ml of hydrochloric acid with a 1.15 density, 415 ml of alumochromophosphate with a ratio of $P_2O_5$:($Al_2O_3$ + $Cr_2O_3$) = 2.3; 3.2 l of ethyl silicate 40 having a 1.05 density, 100 g of disodium salts of sulfosuccinic acid which is a surfactant featuring a wetting and plasticizing effect; 44 kg of pulverized crystalline quartz with a minimum particle size of 50 mu are loaded into a mixer tank, a stirrer speed being 2800 rpm. The composition is being stirred for 60 min.

Suspension viscosity is determined by the time required for the suspension to flow through a 100 ml viscosimeter funnel with a calibrated opening, 4 mm in diameter. The time of efflux of 100 ml of the suspension in seconds is the conventional or just the viscosity of said suspension.

The viscosity measured directly after 60-min stirring was 45 s. Specimens were immersed in said suspension which was applied in three layers, each layer being powdered with quartz sand with 0.2 mm grains and subjected to drying for 3 hrs.

The static bending strength of 3-layer specimens under normal conditions (20° C.) was 57 kgf/cm$^2$ and 107 kgf/cm$^2$ at 900° C. The suspension was stored at 17° C.

The strength of the specimens produced by using the same suspension upon storing for 48 hrs amounted accordingly to 52 and 103.5 kgf/cm$^2$. Within that time period the suspension viscosity increased to 50 s, i.e. it remained within technological limits.

The suspensions employed in other examples were prepared in a similar way. The composition of these suspensions and their parameters are given in a Table.

-continued

| No. of Ex. | Suspension composition, % by weight | | | | | | | Suspension and mold properties | | | | | | | |
|---|---|---|---|---|---|---|---|---|---|---|---|---|---|---|---|
| | Alkyl silicate (name and concentration) | Water | Hydrochloric acid | Phosphate: Phosphoric acid | Phosphate: Diphosphates | | Refractory filler | Viscosity(s) 0 hr | Viscosity(s) 48 hrs | Bending strength kgf/cm² 20° | Bending strength kgf/cm² 900° | Specific bending strength (per 1% of fictitious silica) 20° | Specific bending strength (per 1% of fictitious silica) 900° | Notes |
| 1 | 2 | 3 | 4 | 5 | 6 | 7 | 8 | 9 | 10 | 11 | 12 | 13 | 14 | 15 |
| 29. | " | 17.5 | 0.15 | 0–6 | barium phosphate; 0.8 | " | " | 44 | 58 | 56.4 | 88.0 | 17.5 | 27.5 | |
| 30. | " | 17.5 | 0.15 | 0–6 | chromoalumophosphate; 0.8 | " | " | 36 | 49 | 63.2 | 97.6 | 19.8 | 30.5 | |
| 31. | " | 17.5 | 0.15 | — | iron and titanium phosphates 1:1; 0.8 | " | " | 37 | 42 | 57.6 | 100.6 | 18.0 | 25.5 | |
| 32. | " | 17.5 | 0.15 | — | copper and zirconium phosphates 1:1; 0.8 | " | " | 37 | 43 | 59.8 | | | | |

What we claim is:

1. In a suspension suitable for making molds useful in disposable pattern casting, consisting essentially of from 2.5 to 9.0 percent by weight of a $C_2$–$C_4$ alkyl silicate, from 16.5 to 23.0 percent by weight of water, from 0.05 to 0.25 percent by weight of hydrochloric acid, from 0.02 to 0.10 percent by weight of a surfactant selected from the group consisting of alkyl sulfates, alkyl-aryl sulfonates, salts of sulfosuccinic acid esters, sodium salts of condensation products of fatty acid chlorides with methyl taurine, oxy-ethylated alkyl phenols and aliphatic alcohols, glycidol derivatives of alkyl phenol and sulfonated oxy-ethylated compounds, the balance being refractory filler having a grain size of not more than 50 mu; the improvement comprising from 0.2 to 1.0 percent by weight of a phosphate selected from the group consisting of diphosphates of copper, magnesium, calcium, zinc, aluminum, titanium, chromium, manganese, iron, nickel, cobalt, zirconium and barium, alumochromophosphate and their mixtures.

2. A suspension of claim 1, comprising the following components, the weight percentage of said components being:

ethyl silicate — 8.0
water — 17.5
hydrochloric acid — 0.15
copper diphosphate — 0.9
alkyl-aryl sulfonate — 0.08
pulverized quartz — the balance.

3. A suspension of claim 1, comprising the following components the weight percentage of said components being:

ethyl silicate — 8.0
water — 17.5
hydrochloric acid — 0.15
iron diphosphate — 0.6
alkyl-aryl sulfonate — 0.08
pulverized quartz — the balance.

4. A suspension of claim 1, comprising the following components, the weight percentage of said components being:

ethyl silicate — 8.0
water — 17.5
hydrochloric acid — 0.15
diphosphate of chromium and aluminium — 0.8
surfactant - alkyl-aryl sulfonate — 0.08
refractory filler - pulverized quartz — the balance.

5. A suspension of claim 1, comprising the following components:

ethyl silicate — 3.2 l
water — 14.9 l
hydrochloric acid — 355 ml
alumochromophosphate — 415 ml
disodium salts of sulfosuccinic acid — 100 gms
pulverized crystalline quartz — 44 gms.

6. A suspension of claim 1, wherein the alkyl silicate is ethyl silicate.

* * * * *